United States Patent [19]

Grimnes

[11] 4,261,663

[45] Apr. 14, 1981

[54] MACHINES FOR WRITING BRAILLE TYPE

[76] Inventor: Knut Grimnes, Granhaugen 6, NO-7081 Sjetnhaugan, Norway

[21] Appl. No.: 964,085

[22] Filed: Nov. 27, 1978

[51] Int. Cl.[3] ..... B41J 3/12; B41J 3/32

[52] U.S. Cl. ..... 400/122; 101/18; 101/289; 400/131

[58] Field of Search ..... 400/122, 131, 119; 101/18, 19, 93.02, 93.03, 289

[56] References Cited

U.S. PATENT DOCUMENTS

| | | | |
|---|---|---|---|
| 1,391,426 | 9/1921 | Stewart | 101/18 |
| 2,587,824 | 3/1952 | Dudis | 101/93.02 |
| 2,773,581 | 12/1956 | Ostwaldt et al. | 101/18 |
| 3,266,418 | 8/1966 | Russo | 101/93.02 |
| 3,703,950 | 11/1972 | Armstrong et al. | 400/122 |
| 3,880,269 | 4/1975 | Carbonneau | 400/122 |
| 4,108,066 | 8/1978 | Andersson | 400/122 |

FOREIGN PATENT DOCUMENTS

| | | | |
|---|---|---|---|
| 2350961 | 9/1977 | France | 400/122 |

*Primary Examiner*—William Pieprz

[57] ABSTRACT

Machines for writing braille type having two opposing rows of embossing units each with a support holding a punch-forming stamp guidable between an inactive position and a pushed-out embossing position with abutment against a die member disposed opposite the embossing unit. An electromagnet for each unit controls the stamp with a displaceable plunger. The rows of units are arranged for synchronous movement towards and away from each other in a direction substantially at right angles to the path of movement of a sheet for receiving the type. Each opposing support forms coherent die-punch pairs. Each support has a double-armed rocker which with one end abuts an impressing end of the embossing stamp while the other end projects outwards so that on movement of the support towards the path of the sheet, it is guided substantially at right angles towards the end of the plunger of the electromagnet when said plunger is pushed out.

2 Claims, 2 Drawing Figures

MACHINES FOR WRITING BRAILLE TYPE

BACKGROUND OF THE INVENTION

1. Field of the Invention

This invention relates to machines for writing braille type and having a series of embossing units each with a support which holds a punch-forming stamp which can be guided between a drawn-in and a pushed-out embossing position with abutment against a die member disposed opposite the embossing unit, and an electromagnet arranged for each embossing unit so as to control the position of the stamp with a displaceable plunger.

2. Description of the Prior Art

Such a machine is known in which the embossing units are arranged permanently by the side of each other and in which the stamp movement of the electromagnet is transferred by means of a stationarily mounted, pivotable arm with an activating end which abuts the punch-forming stamp. Such a solution is space-consuming for one thing because the control plunger of the electromagnet must perform a relatively long activating movement. Besides, such a machine only provides the possibility for one-sided embossing of the sheet. Furthermore, the known solution provides for positioning of the magnets in series by the side of each other which demands precise and individual adjustment of the blow in order to bring about uniform and satisfactory embossing.

What is needed then is a compact machine for writing braille type in which the operation can be effected with the least possible inspection and maintenance and with printing on both sides of the sheet.

SUMMARY OF THE INVENTION

Accordingly the present invention resides in a machine for writing braille type which comprises two opposing series of embossing units arranged to extend on either side and transversely of a sheet for receiving said type; means for guidably moving said units in synchronism towards and away from said sheet; means for advancing said sheet in a path of movement substantially at right angles to the path of movement of said units; each of said embossing units comprising a housing, a punch-forming stamp supported in said housing for guidable displacement between a withdrawn inactive position and a pushed-out embossing position relative to an end face of said housing, the end faces of said housings of one series of embossing units being arranged during embossing in close face-to-face relation with the end faces of said housings of the other series of embossing units and each face being formed with a depression disposed for abutting reception of a pushed-out stamp of an opposing housing whereby pairs of opposing housings form associated die-punch pairs, an electromagnet housing a plunger and energisable to outwardly displace said plunger and a double-armed rocker pivotally supported by said housing, one arm being arranged to bear on said plunger in its outwardly displaced position as said opposing series of units are moved towards each other to cause said rocker to pivot and with its other arm to actuate said stamp with said end faces in close face-to-face relation; and means for controllably energising said electromagnets to bring about embossing of said sheet in a predetermined manner.

Such a machine creates the possibility for a simple and reasonable translation from normal type or black type to braille type or point type. The routine character transformations can be built into a data machine program in a known manner so that the type conversion is limited to an entering of normal type.

BRIEF DESCRIPTION OF THE DRAWINGS

In order that the invention can be more clearly understood, a preferred embodiment thereof will now be described, by way of example, with reference to the accompanying drawings in which.

DESCRIPTION OF THE PREFERRED EMBODIMENT

Figure 1:
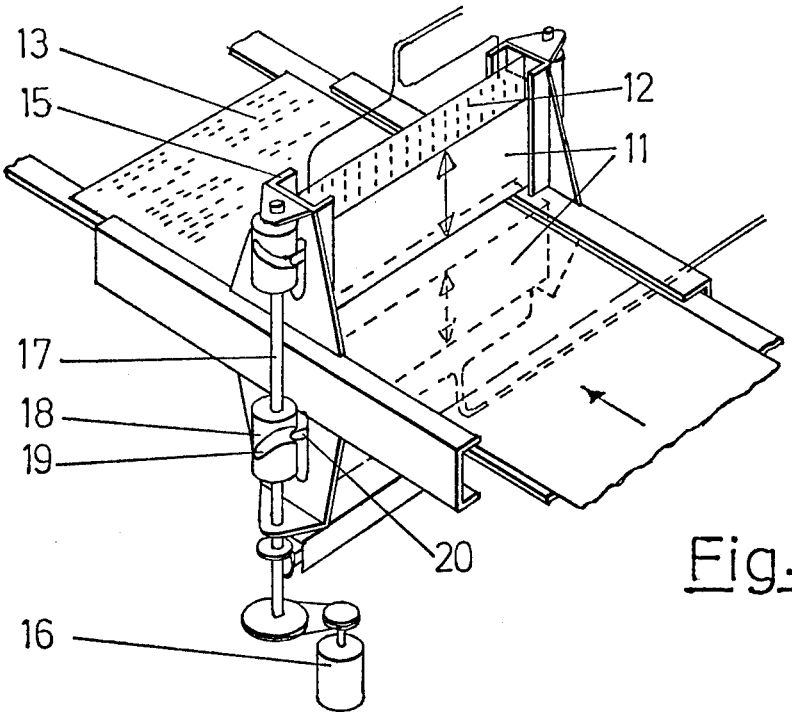
FIG. 1 is a perspective representation of two embossing bridges for a machine according to the invention.
Figure 2:
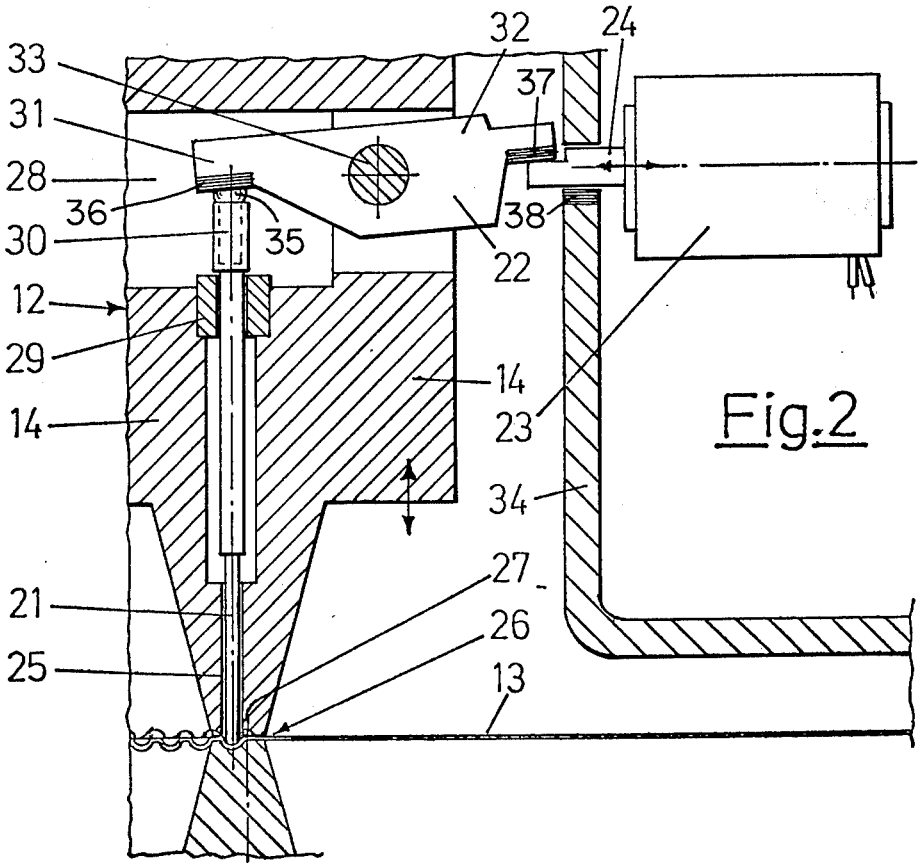
FIG. 2 is a section through the central portions of an embossing unit.

Referring to FIG. 1, two embossing aggregates or bridges 11 each have a series of embossing units 12 disposed one after the other in the longitudinal direction of the embossing bridge. Each embossing unit is adapted to lay down (or not to lay down) a point-shaped elevation in a point position in the braille type along transverse lines on a sheet 13 which is led in a path between the embossing units. The design of the embossing units will be described further below. The number of embossing units 12 thus corresponds to the number of point positions along a written line on the sheet 13.

In addition to the embossing bridges 11, the embossing machine comprises an advancing means for the sheet, a gripping means which holds the sheet still during embossing and a folding means. These components can be designed in a manner corresponding to that of the known "printers" and hence will not be described further. The gripping means can, if desired, be excluded due to the fact that the embossing bridges hold the sheet in position.

While sheet 13 preferably consists of paper, it can alternatively consist of a synthetic plastics material, thin metal plate, coated textile material or the like and can be perforated along the edge in order to ensure reliable control of the advancement. It is fed and collected up as is conventional with known machine writers.

The embossing bridges 11 are mounted with guides 15 so that they can be moved towards each other simultaneously. For this purpose, there can be employed a motor 16 which drives a common shaft 17 at each end of the embossing bridges. Each shaft 17 is provided for each embossing bridge with a cam cylinder having a cam groove which engages a drive pin 20 at the end of the embossing bridge. For each rotation of the shaft 17, the embossing bridges are guided inwardly towards each other and back to the starting position.

Each embossing unit 12 comprises a housing or support 14 having an embossing stamp 21, an activating arm 22 for the embossing stamp and a solonoid 23 having a control plunger 24.

The housing 14 can be regarded as disc-shaped with a thickness which is equal to the distance between two point positions. It is provided with a duct 25 which extends in the direction of movement towards the path of the sheet and which holds and controls the embossing stamp 21. The breadth of the housing diminishes forwardly to the end surface 26 against the sheet path. This end surface together with the embossing stamp has a double function: the embossing stamp 21 shall stamp an elevation in the sheet towards the opposite side of the latter while the end surface 26 forms an abutment for simultaneous embossing of an elevation towards the embossing unit. For this purpose, the end surface 26 is provided with a depression 27. This depression will form, together with the end of the embossing stamp 21, the die-punch pair which is required to produce a point-shaped elevation in the sheet. The point positions on the two sides of the sheet are thus displaced relative to each other a distance which corresponds to the central distance between the embossing stamp 21 and the depression 27. The duct 25 is widened somewhat at the innermost end and discharges into a transverse space or cage 28 in the housing 14 for the activating arm 22. At the mouth of the duct 25, there is inserted a control bushing 29 for the embossing stamp 21 which has a somewhat larger diameter in this region and is provided with an expanded head 30 against the activating arm.

In order to take up the variations in dimensions of the moveable parts it can be appropriate to introduce an elastic element in the power route between the electromagnet and the embossing stamp. There can for example, be affixed a rubber pillow 35 on the head 30 or corresponding rubber parts 36, 37 on the ends of the activating arm. Variations in the dimensions will then lead to a variation in the pressure force instead of in the movement. Such an elastic element will besides reduce the noise which otherwise will arise when the apparatus is driven.

The activating arm 22 is a double-armed rocker which is mounted at the side of the axis of the embossing stamp. The one portion projects inwardly above the head 30 and forms a hammer 31 while the other portion 32 projects outside the housing 14. The activating arm 22 can, for example, be mounted on a common, through-running shaft 33 for all the housings of each embossing bridge.

The series of housings 14 are held together in an appropriate manner, for example, by producing them as a coherent unit in one piece.

Up to the series of housings 14, by the side of the moveable portion of each embossing bridge 11, there is arranged for each housing a solonoid 23 mounted in a fixed beam with a control plunger having an outwardly projecting pin 24 which is supported at its under edge by an elastic element 38 and which can be led into the path of the portion 32 of the activating arm 22 when the embossing bridges are moved towards each other. The elastic element serves the same purpose as the elastic element which is mentioned above and can, if necessary, replace it. When the pin 24 is withdrawn, the activating arm 22 is moved freely past. The embossing stamp will only strike against the sheet 13 with its force of inertia which is too small to leave its mark in the sheet. The force of inertia can be reduced or eliminated, if necessary by means of a helical spring or the like. When the solonoid 23 is actuated so that the pin 24 is pushed outwards it, in turn, retains the portion 32 of the activating arm 22 so that the activating arm is rocked and presses the embossing stamp 21 with the end outwards from the end surface 26 of the housing. On abutment against the depression 27 there will thereby be left a point-shaped elevation in the sheet between the two embossing bridges. With two housings 14 disposed against each other on opposite sides of the sheet there will thus be left a point-shaped elevation on each side of the sheet. This reduces the cost of paper by half.

The supply of current to the individual solonoids 23 is controlled by a data machine which, in a manner known per se, is programmed to produce point-shaped elevations in the relevant positions.

It is appropriate to design the embossing units so that the opposing end surfaces bear against each other and hold the sheet in position before the embossing stamp is pushed out. This can, for example, be obtained by providing the housing 14 with a spring-loaded end piece which is pressed inwards a little against the force of the spring in the direction of movement of the embossing stamp when it thrusts against the sheet simultaneously with the end piece of the opposing embossing unit housing. Such end pieces can be displaceably locked in an appropriate manner to the respective housings or supports.

The embodiment of the invention described above has each embossing unit forming a punch and a die portion. For certain purposes, for example, in the production of drawings, it can be appropriate to allow the embossing units on the one side of the sheet path to form die portions exclusively, that is to say missing embossing stamps, while the embossing units on the other side can omit the depressions 27 and only form punch portions.

I claim:

1. A compact machine for writing braille type on both sides of a sheet and which comprises two opposing series of embossing units arranged to extend on either side and transversely of said sheet for receiving said type, the number of embossing units in a series corresponding to the number of point positions along a written line of braille type on said sheet; means for guidably moving said units in synchronism towards and away from said sheet; means for advancing said sheet in a path of movement substantially at right angles to the path of movement of said units; each of said embossing units comprising a housing of disc-like shape with a thickness substantially equal to the distance between two point positions, a punch-forming stamp supported in said housing for guidable displacement between a withdrawn inactive position and a pushed-out embossing position relative to an end face of said housing, the end faces of said housings of one series of embossing units being arranged during embossing in close face-to-face relation with the end faces of said housings of the other series of embossing units, each face being formed with a depression disposed for abutting reception of a pushed-out stamp of an opposing housing whereby pairs of opposing housings form associated die-punch pairs capable of forming point positions on the two sides of said sheet which are offset relative to each other and said end faces of said housings of opposing embossing units having means for bearing resiliently against opposite sides of said sheet to hold the latter in position prior to actuation of said stamps, an electromagnet housing a plunger and energisable to outwardly displace said plunger and a double-armed rocker pivotally supported by said housing, one arm being arranged to bear resiliently on said plunger in its outwardly displaced position as said opposing series of units are moved towards each other to cause said rocker to pivot and with its other arm to actuate said stamp resiliently with said end faces in close face-to-face relation; and means for controllably energising said electromagnets to bring about embossing of said sheet in a predetermined manner.

2. The machine of claim 1, wherein each of said stamps is resiliently supported against its force of inertia in its respective housing.

* * * * *